US008758281B2

(12) United States Patent
Biggie et al.

(10) Patent No.: US 8,758,281 B2
(45) **Date of Patent: *Jun. 24, 2014**

(54) VIBRATIONAL SUPPORT SURFACE

(75) Inventors: Lydia B. Biggie, Lighthouse Point, FL (US); Marco A. Paez, Lantana, FL (US); David M. Genaro, North Lauderdale, FL (US); John Biggie, Lighthouse Point, FL (US)

(73) Assignee: Anodyne Medical Device, Inc., Los Angeles, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/551,069

(22) Filed: Jul. 17, 2012

(65) Prior Publication Data

US 2012/0283609 A1 Nov. 8, 2012

Related U.S. Application Data

(63) Continuation of application No. 12/105,584, filed on Apr. 18, 2008, now Pat. No. 8,235,920.

(60) Provisional application No. 60/913,050, filed on Apr. 20, 2007.

(51) Int. Cl.
*A61H 1/00* (2006.01)

(52) U.S. Cl.
USPC ..... 601/46; 601/149

(58) Field of Classification Search
USPC ..... 601/148–156, 46; 602/13, 19; 606/201, 606/202
See application file for complete search history.

(56) References Cited

U.S. PATENT DOCUMENTS

| | | | | |
|---|---|---|---|---|
| 4,679,863 | A * | 7/1987 | Ikeda et al. | 303/3 |
| 5,052,377 | A | 10/1991 | Frajdenrajch | |
| 5,588,955 | A * | 12/1996 | Johnson et al. | 601/152 |
| 6,494,852 | B1 * | 12/2002 | Barak et al. | 601/151 |
| 6,820,640 | B2 | 11/2004 | Hand et al. | |
| 7,063,676 | B2 * | 6/2006 | Barak et al. | 601/150 |
| 7,322,947 | B2 | 1/2008 | Flick et al. | |
| 2002/0042585 | A1 * | 4/2002 | Kloecker | 602/13 |
| 2005/0011518 | A1 * | 1/2005 | Biondo et al. | 128/204.18 |
| 2008/0078033 | A1 | 4/2008 | Wyatt et al. | |

* cited by examiner

*Primary Examiner* — Michael A. Brown
(74) *Attorney, Agent, or Firm* — Nixon & Vanderhye P.C.

(57) ABSTRACT

A vibration and modulation system is provided for an array of air cells. The vibration and modulation system includes an air source, a high-pressure reservoir in fluid communication with the air source, and at least one valve coupled between the high-pressure air source and the array of air cells. A control assembly is coupled with the at least one valve and selectively controls a position of the valve to effect a vibratory action in the array of air cells.

10 Claims, 4 Drawing Sheets

VIBRATIONAL SUPPORT SURFACE

CROSS-REFERENCES TO RELATED APPLICATIONS

This application is a continuation of U.S. patent application Ser. No. 12/105,584, filed Apr. 18, 2008, now U.S. Pat. No. 8,235,920, which claims the benefit of U.S. Provisional Patent Application Ser. No. 60/913,050, filed Apr. 20, 2007, the entire contents of each of which are hereby incorporated by reference in this application.

STATEMENT REGARDING FEDERALLY SPONSORED RESEARCH OR DEVELOPMENT (NOT APPLICABLE)

BACKGROUND OF THE INVENTION

There is a need for support surfaces to provide a therapeutic vibrational action or force to a patient suffering from respiratory ailments. Percussors and vibrators are known to stimulate the expectoration of mucous from the lungs. Vibratory or undulating action applied to the body adjacent the thoracic cavity aids in postural draining or coughing up of sputum and thereby reduces the amount of mucous that lines the inner walls of the alveoli.

It is commonly regarded that vibrational therapy can provide both percussion and vibration. Vibration, for example, provides approximately 1 to 7 beats per second, while percussion typically provides 7 to 25 beats per second.

There are support surfaces on the market today that operate a mechanical or pneumatic external device that imparts the vibratory action. Others use many solenoid valves in combination to control and regulate flow, pressurizing and venting of the vibration air cells. Others use a cam action, large diaphragms or alternating action of relatively large size dual valves to move the air in and out of the vibration air cells.

All the current methods have extensive mechanical and electro-mechanical components such as valves, motors, lever arms, cams, large diaphragms, fluidic connections and the like. They also use finger shaped air cells for the vibratory air cells.

BRIEF SUMMARY OF THE INVENTION

In an exemplary embodiment, a vibration and modulation system is provided for an array of air cells. The vibration and modulation system includes an air source, a high-pressure reservoir in fluid communication with the air source, and at least one valve coupled between the high-pressure air source and the array of air cells. A control assembly is coupled with the at least one valve and selectively controls a position of the valve to effect a vibratory action in the array of air cells. The air source is preferably a pump, although other sources may be suitable. A size of the high-pressure reservoir is preferably determined based on a total volume of air required to inflate the air cell array to a minimum pressure.

The control assembly may include a pressure sensor in the high-pressure reservoir that triggers a position of the at least one valve according to a pressure in the high-pressure reservoir. Alternatively, the control assembly may include a check valve with a predetermined cracking pressure disposed between the high-pressure reservoir and the at least one valve. The predetermined cracking pressure is determined according to a desired frequency of vibratory action. In still another variation, the control assembly includes a timing circuit coupled with the at least one valve that controls a position of the at least one valve on a predetermined time interval. In still another alternative arrangement, the control assembly includes a pilot valve coupled with the at least one valve that enables high pressure fluid from the high-pressure reservoir to control a position of the at least one valve.

In one arrangement, the air source and the high-pressure reservoir are coupled with the at least one valve in parallel.

The system may additionally include evacuation structure coupled with the air cell array that enables quick deflation of the air cell array. In this context, the evacuation structure may comprise a vent on the at least one valve. The evacuation structure may additionally include a vacuum source coupled with the vent.

In another exemplary embodiment, a support surface includes an array of air cells, and the described vibration and modulation system coupled with the air cell array, where the vibration and modulation system effects vibratory action on the air cell array. Preferably, when deflated, the air cells are substantially flat. Each of the air cells may additionally include an air cell node including a foam insert disposed in an air sealable container.

In yet another exemplary embodiment, a vibration and modulation system for an array of air cells for use with a support surface includes an air source, a high-pressure reservoir in fluid communication with the air source, and a multi-position valve coupled between the high-pressure air source and the array of air cells. In a first position, the valve permits air to flow from the high-pressure reservoir to the air cells, and in a second position, the valve evacuates air from the air cells to atmosphere. A control assembly is coupled with the valve and selectively controls a position of the valve to effect a vibratory action in the array of air cells.

DETAILED DESCRIPTION OF THE INVENTION

Figure 1:
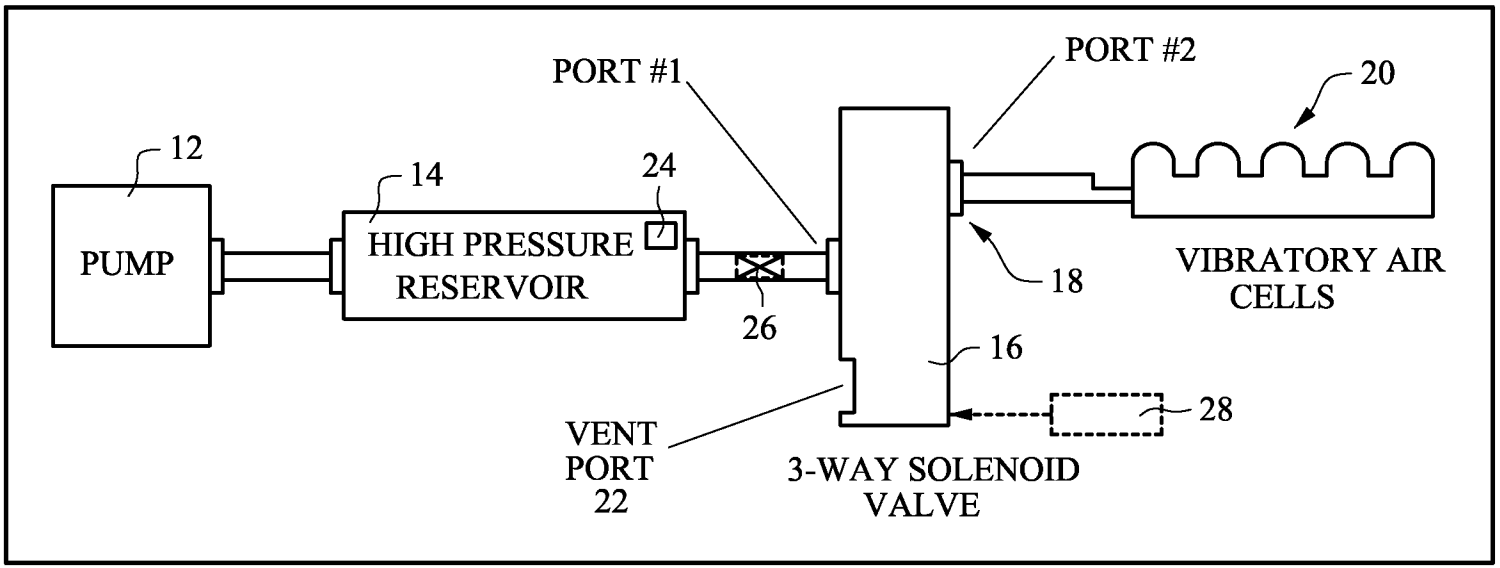
FIG. 1 is a schematic diagram of a vibration and modulation system according to a first embodiment.

With reference to FIG. 1, an exemplary embodiment includes an air source 12, such as a pump, connected to a high-pressure reservoir 14, connected to a valve 16 such as a 3-way solenoid valce. A connecting valve 18 connects to the air cells 20 used for vibration and percussion, and a vent port 22 is a vented to atmosphere, which vents the air cells 20. The air cell array 20 includes small air cells, either generally flat when deflated (two-dimensional) or nodal cylinders or other shape (three-dimensional) connected together in a pattern.

The vibratory system of the described embodiments can be used and integrated into any support mattress system and hospital bed frame. Alternatively, the system can be a stand-alone system used on any patient on any hospital mattress and bed frame.

Reservoir

The reservoir 14 can be any soft sided or hard-sided container of any suitable shape. It is preferably large enough to contain enough pressurized fluid (air, water, etc.) to allow the air cells 20 to quickly inflate. The total volume of air required for the air cells 20 to inflate quickly to a minimum high pressure and the pressure levels in the reservoir 14 determines the reservoir size.

Air Source

The air source 12 can be any type of pump (compressor, diaphragm, rotary, etc.) that supplies a sufficient volume of air to keep the reservoir 14 full of pressurized fluid.

Frequency Control

The vibration or modulation frequency (beats/sec) is controlled either by pressure or by time.

Pressure Method (a) In one arrangement, a pressure sensor transducer 24 senses the pressure in the reservoir 14. At certain pressures, the transducer 24 sends a signal to the solenoid valve 16 for it to either open or close, thereby allowing filling of the air cells 20 or venting of the air cells 20. By changing and setting the desired pressures, the frequency of the vibratory action can be controlled by the caregiver.

(b) In another arrangement, a check valve 26 is connected between the high-pressure reservoir 14 and the solenoid valve 16. Check valves have a set cracking pressure (i.e., the valves are held open when a certain pressure is maintained). When the pressure drops below that level, the valve 26 closes again. By choosing the desired check valve 26 with its predetermined cracking pressure, the frequency of pressure variations and therefore the frequency of vibratory action can be controlled.

Valves

There are two exemplary methods, both using valves, to control the high-pressure air filling the air cells 20.

(a) Solenoid valves, such as a 3-way solenoid valve 16 shown in FIG. 1, allow the inlet port to pass air (from reservoir 14) to the exit port (to the air cells 20), and the vent port 22 allows air from the air cells 20 to vent to atmosphere. If the vent port 22 is open, the inlet port to the air cells is closed. The valve 16 opens and closes upon signals, for instance, from a timing circuit 28. The valve 16 opens and closes its ports using electro-magnetic force or the like. The larger the required ports in the valve, the higher the wattage requirement of the valve.

(b) Pilot valves (not shown) may also be suitable. Since the pressure is high from the reservoir 14, a pilot valve may be used instead of the typical solenoid valve 16. With this structure, the high-pressure fluid itself will move the valve instead of the electro-magnetic force or the like.

Timing Method

A timing circuit or a timing chip 28 can be connected to the solenoid valve 16. The circuit 28 opens and closes the solenoid valves 16, which in turn allows the air cells 20 to fill and then to vent within a set period. The timing circuit 28 can have either a fixed on/off period or could be programmed by the user through the use of microprocessors.

Pressure Reservoir

The utilization of a pressure reservoir 14 allows for a continuous supply of high pressure to be quickly released, via the valve 16, to the air cells 20, allowing very rapid inflation of the air cells 20. The reservoir 14 avoids complete reliance on the pump 12 to rapidly fill the air cells. If a reservoir was not used, a significantly larger capacity pump would be required to guarantee a sufficient supply of air. An example of a suitable pump is a centrifugal pump known as "Windjammer" made by Ametek. This type of high volume but low pressure blower is widely used in the industry. The supplied air would be most likely be at a lower pressure than the reservoir 14, but the larger capacity pump 12 would be needed to quickly inflate the air cells. Also, with lower pressure air directly from the pump 12, the air cells 20 may not reach a high pressure within the short time frame, and this affects the quick venting required to provide the vibratory action. At lower pressures, the venting action would be slower. As can be seen, this high pressure reservoir vibration system is particularly useful in support surfaces that utilize a smaller piston or diaphragm pump with relatively low CFMs.

Figure 2:
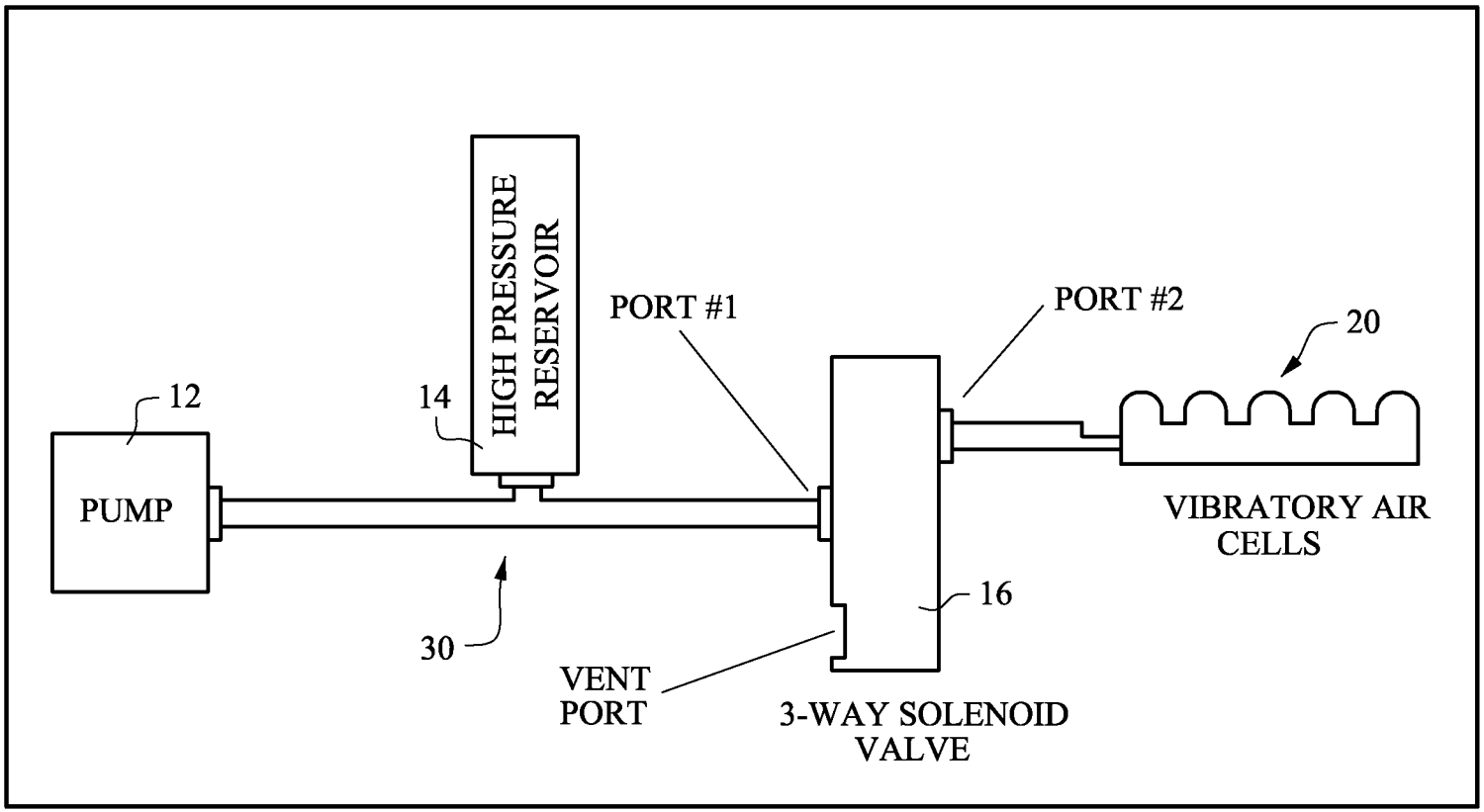
FIG. 2 is a schematic diagram of a second embodiment.

In a variation of the first embodiment, with reference to FIG. 2, the reservoir 14 can have a parallel (Tee) connection 30 between the pump 12 and the valve 16. This allows air to flow not only from the reservoir 14, but also from the pump 12 at the same time. This variation might be used, for example, if the size of the reservoir 14 had to be limited.

Deflation of Air Cells

Figure 3:
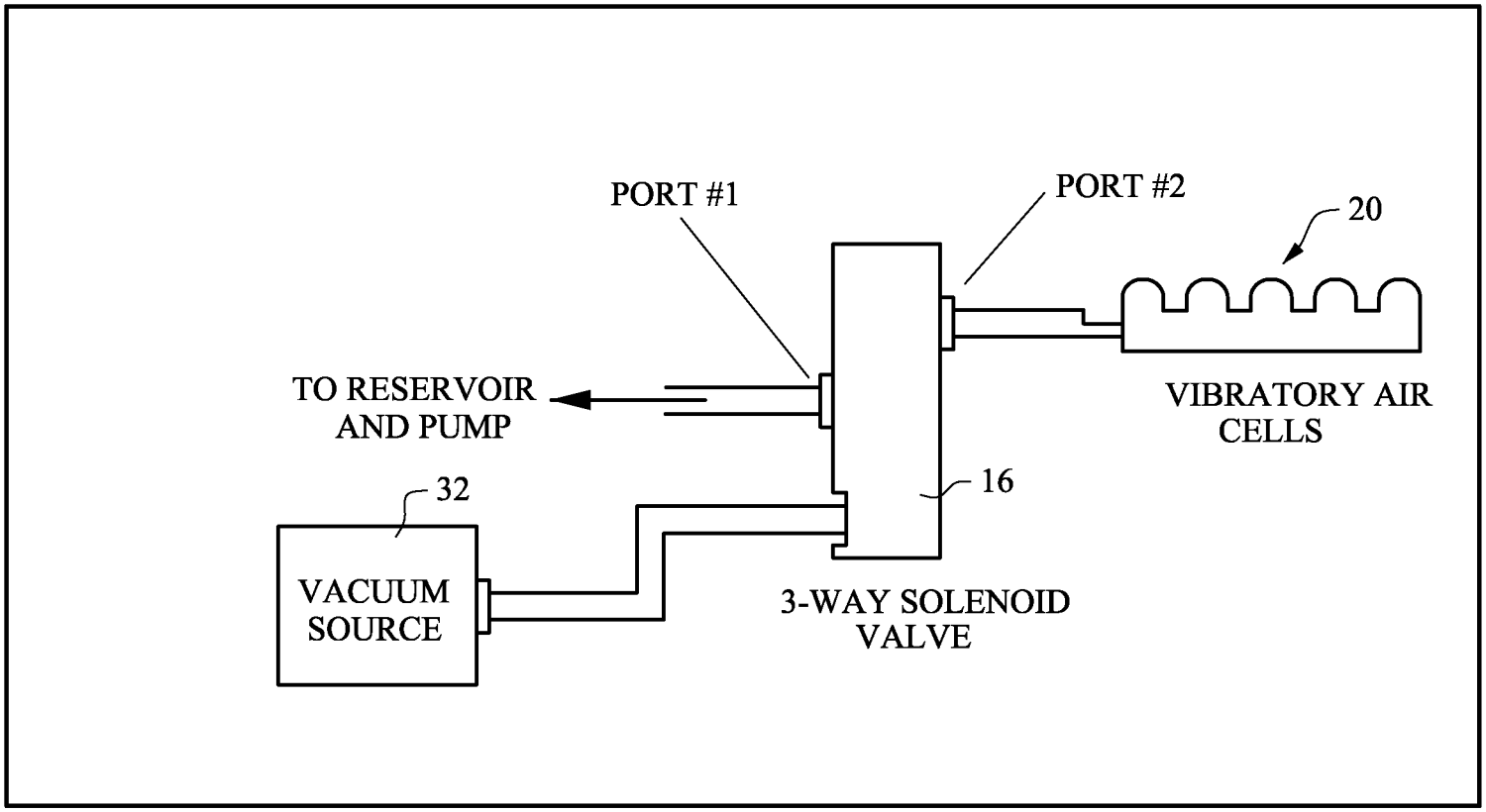
FIG. 3 is a schematic diagram of a system including a vacuum source for rapid evacuation of the air cells.

As previously mentioned, with a high-pressure reservoir 14 it is possible, in the described embodiments, to quickly deflate the air cells 20 simply by venting through the solenoid valve 16. If large air cells are desired, or other conditions exist which inhibit the natural venting, however, a vacuum source 32 can be utilized to deflate the air cells. The vacuum source 32 is shown in FIG. 3.

Air Cells

Figure 4:
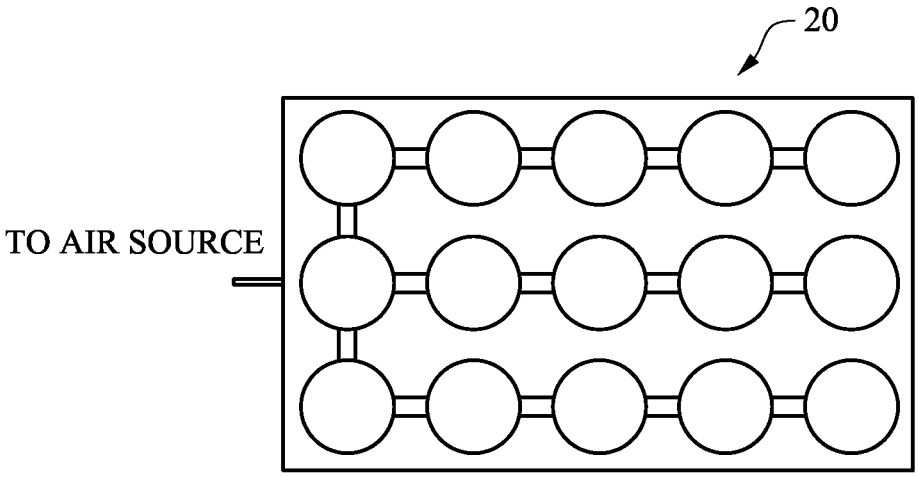
FIG. 4 shows an exemplary two-dimensional air cell array.

The air cells 20 used for inflation, otherwise known as bladders, have either a 2D or 3D configuration. For the two-dimensional variation, with reference to FIG. 4, the cells are relatively small circles, oblongs, rectangles or squares. They are generally flat (2D) in the deflated condition. For example, a circular shape might have an OD of 3" in the deflated condition. A multitude of these small shapes make up an array, with individual circles connected with tubing or passageways between the circles.

Figure 5:
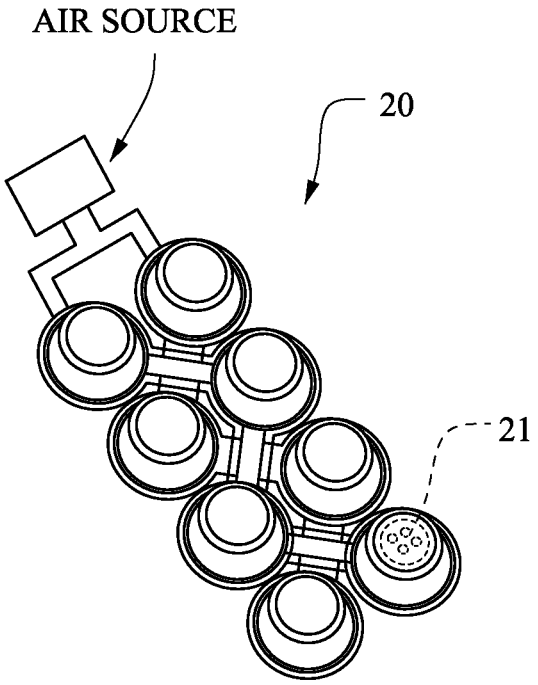
FIG. 5 shows an exemplary three-dimensional air cell array.

For the three-dimensional shape, with reference to FIG. 5, each cell is a small node, something like a cylindrical canister. Again these nodes can be connected to form a nodal array as shown. An example of suitable construction is described in U.S. patent application Ser. No. 11/866,602, the contents of which are incorporated by reference. The nodes could have a foam insert 21 inside each one. A vacuum source is used to deflate each node. When the vacuum is turned off, the foam 21 expands and helps to re-inflate each node, causing the vibratory action.

Whether 2D or 3D, these cell shapes have less volume than the finger cells currently on the market. The smaller volume allows for a more effective and quick control of the air or fluid entering and leaving the air cell. The smaller the volume of the vibrating air cells, the better the percussion or vibration will be, i.e., more beats per second and at higher pressure.

The air cells can be constructed out of any suitable material such as urethane, supported urethanes, vinyl, and supported vinyl. The air cells are preferably sealed to form an airtight volume. The sealing process could be RF welding, heat or ultrasonic sealing, adhesive or other methods.

The vibratory air cells are placed under the patient's back around the chest area. They may be used alone or in conjunction with other support surfaces.

Comparison of Other Inventions

The exemplary embodiments described herein differ from others in that the reservoir 14, or accumulator, is used that is at a pressure higher than atmosphere and higher than that developed by a relatively small pump. Typical pressures might be 1 to 8 psi. By utilizing a high-pressure reservoir 14, smaller solenoid valves 16 can be used, which have smaller opening ports. The high pressure passed through the solenoid valve 16 allows the air cells 20 to inflate very rapidly and to a high pressure. Other systems use air directly from the air source, which passes through valves and then into the air cells. A high-pressure reservoir is not utilized.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

The invention claimed is:

1. A vibration and modulation system comprising:

an array of air cells defining a support surface, the array of air cells consisting of a planar construction cooperable with a support mattress;

an air source;

a high-pressure reservoir in fluid communication with the air source, the high-pressure reservoir storing fluid under pressure;

at least one valve coupled between the air source and the array of air cells; and a control assembly coupled with the at least one valve, the control assembly being programmed to selectively control a position of the valve to effect a vibratory action in the array of air cells by inflating and deflating the array of air cells, wherein the air source and the high-pressure reservoir are cooperable to inflate the array of air cells.

2. A vibration and modulation system according to claim 1, wherein the air source comprises a pump.

3. A vibration and modulation system according to claim 1, wherein a size of the high-pressure reservoir is determined based on a total volume of air required to inflate the air cell array to a minimum pressure.

4. A vibration and modulation system according to claim 1, wherein the control assembly comprises a pressure sensor in the high-pressure reservoir, the pressure sensor triggering a position of the at least one valve according to a pressure in the high-pressure reservoir.

5. A vibration and modulation system according to claim 1, wherein the control assembly comprises a check valve with a predetermined cracking pressure disposed between the high-pressure reservoir and the at least one valve, wherein the predetermined cracking pressure is determined according to a desired frequency of vibratory action.

6. A vibration and modulation system according to claim 1, wherein the air source and the high-pressure reservoir are coupled with the at least one valve in parallel.

7. A vibration and modulation system according to claim 1, further comprising evacuation structure coupled with the air cell array, the evacuation structure enabling quick deflation of the air cell array.

8. A vibration and modulation system according to claim 7, wherein the evacuation structure comprises a vent on the at least one valve.

9. A vibration and modulation system for an array of air cells, the vibration and modulation system comprising:

an air source;

a high-pressure reservoir in fluid communication with the air source, the high-pressure reservoir storing fluid under pressure;

at least one valve coupled between the air source and the array of air cells; and a control assembly coupled with the at least one valve, the control assembly being programmed to selectively control a position of the valve to effect a vibratory action in the array of air cells by inflating and deflating the array of air cells, wherein the air source and the high-pressure reservoir are cooperable to inflate the array of air cells, wherein the control assembly comprises a timing circuit coupled with the at least one valve, the timing circuit being programmed to control a position of the at least one valve on a predetermined time interval.

10. A vibration and modulation system for an array of air cells, the vibration and modulation system comprising:

an air source;

a high-pressure reservoir in fluid communication with the air source;

a vibration source, wherein the air source and the high-pressure reservoir are cooperable to inflate the array of air cells and are in selective fluid communication with the array of air cells based on a position of the vibration source, wherein the vibration source comprises a 3-way solenoid valve including an inlet port, an exit port, and a vent port, and wherein the 3-way solenoid valve is configured such that the inlet port passes air from the high-pressure reservoir to the exit port, such that the vent port allows air from the air cells to vent to atmosphere, and such that if the vent port is open, the inlet port to the air cells is closed; and a timing circuit coupled with the 3-way solenoid valve, the timing circuit being programmed to control a position of the 3-way solenoid valve on a predetermined time interval.

* * * * *